United States Patent [19]

Cabado

[11] Patent Number: 4,708,744

[45] Date of Patent: Nov. 24, 1987

[54] PROCESS FOR PHOSPHATING METAL SURFACES AND ESPECIALLY IRON SURFACES

[75] Inventor: Ramon B. Cabado, Barcelona, Spain

[73] Assignee: Henkel Kommanditgesellschaft auf Aktien, Duesseldorf, Fed. Rep. of Germany

[21] Appl. No.: 832,923

[22] Filed: Feb. 24, 1986

[30] Foreign Application Priority Data

Feb. 22, 1985 [ES] Spain ..... 541.129

[51] Int. Cl.[4] ..... C04B 9/02

[52] U.S. Cl. ..... 106/14.12; 106/14.15; 148/6.15 R; 427/331; 427/421; 427/433

[58] Field of Search ..... 106/14.12, 14.15; 148/6.15 R, 6.15 Z; 568/708; 427/331, 421, 433

[56] References Cited

U.S. PATENT DOCUMENTS

| | | | |
|---|---|---|---|
| 2,743,204 | 4/1956 | Russel | 148/6.15 |
| 2,884,351 | 2/1959 | Cavanagh et al. | 148/6.15 |
| 4,292,096 | 9/1981 | Murakami et al. | 148/6.15 Z |
| 4,389,260 | 6/1983 | Hauffe et al. | 148/6.15 Z |
| 4,419,199 | 12/1983 | Hauffe et al. | 148/6.15 Z |
| 4,498,935 | 2/1985 | Kent et al. | 148/6.15 Z |

FOREIGN PATENT DOCUMENTS

| | | |
|---|---|---|
| 0056881 | 8/1982 | European Pat. Off. . |
| 0069950 | 1/1983 | European Pat. Off. . |
| 1072055 | 12/1959 | Fed. Rep. of Germany . |
| 2818426 | 11/1978 | Fed. Rep. of Germany . |
| 1171459 | 1/1959 | France . |
| 983924 | 2/1965 | United Kingdom . |
| 1542222 | 3/1979 | United Kingdom . |

OTHER PUBLICATIONS

Dr. Werner Rausch, "Die Phosphatierung von Metallen", Leuze Verlag (pub), 1974, p. 102, Aug. 1974.

00084, 23 Jun. 1986, European Patent Office Search Report.

*Primary Examiner*—Theodore Morris

*Attorney, Agent, or Firm*—Ernest G. Szoke; Henry E. Millson, Jr.; Mark A. Greenfield

[57] ABSTRACT

A phosphate conversion coating aqueous solution and method for its use, which solution contains zinc ions and phosphate ions, and an oxidation accelerator composition comprising (a) a bromate compound and (b) a nitroaromatic.

34 Claims, No Drawings

PROCESS FOR PHOSPHATING METAL SURFACES AND ESPECIALLY IRON SURFACES

BACKGROUND OF THE INVENTION

1. Field of the Invention

This invention relates to solutions for forming phosphate conversion coatings on metal substrates, and particularly to such solutions containing an accelerator composition, as well as a method for the use of such solutions.

2. Statement of the Related Art

It is known in the art to form phosphate conversion coatings on metal surfaces, including iron, zinc, aluminum, and their various alloys such as steel, for the purposes of improving corrosion resistance and providing an adhesion base for subsequent coatings.

British Pat. No. 983,924 describes phosphating solutions containing zinc phosphate and manganese phosphate with an oxidizing accelerator composition comprising nitrate ions, and optionally nitrite ions. Other, optional, ingredients include tartaric acid and bromide ions. The oxidizing accelerator is particularly useful in the coating of ferrous surfaces, in which instance ferrous ions enter the phosphating solution and are oxidized to ferric ions, which results in a more consistent coating. A total acidity of greater than 20 points is disclosed, although the only working example has a total acidity of 30 points. The temperature of the phosphating solution was ambient (22° C.), and the metal surfaces were sprayed with the solution for 1 minute.

German published patent application No. 28 18 426 describes a phosphating coating solution containing boron fluoride and using nitrate ions as the oxidation accelerator, optionally combined with chlorate and/or nitrite ions. The solution is particularly useful for coating aluminum surfaces. The disclosed compositions appear to have poor storage stability, and it is believed that this would require replenishment or adjustment of the phosphating solutions before each use.

British Pat. No. 1,542,222 describes phosphate conversion coating solutions containing zinc and phosphate and oxidizing acceleration compositions containing as essential ingredients, chlorates and sodium nitrobenzene sulfonate (SNBS). Nitrate ions are preferably also present. In the disucssion of prior art, mention is made of various proposed accelerators for zinc phosphate coating solutions, including organic nitro compounds (such as SNBS), nitrates, nitrites, hydrogen peroxide, and chlorates, bromates, and iodates. There is no further disclosure of bromates, although reference is made to British Pat. No. 828,916 for a zinc phosphate coating solution containing calcium.

Published German patent application No. 24 18 118 describes a conversion coating solution containing phosphate ions, and a wetting agent/possibly accelerator which can be a bromate or nitroorganic. Phosphating is carried out in two stages, in which the phosphate ions are increased and the wetting agent is decreased in the second stage.

Published German patent application No. 22 32 067 and corresponding Belgian Pat. No. 785,828 discloses a conversion coating solution containing zinc ions and phosphate ions in a 1:12–100 ratio, which ratio is used to regulate the coating quality. Nickel ions, manganese ions, or calcium ions may be added to provide further acid resistance.

Other prior art describes attempts to improve phosphating processes with respect to their efficiency, controllability, storage stability, and galvanoplastic features. For example, a rapidly acting secondary oxidant may be employed in an amount sufficient to oxidize ferrous ions to ferric ions, but not in an amount sufficient to have a dipolarizing effect and act as the primary oxidizing accelerator. Suitable rapidly acting secondary oxidants include alkaline metal or ammonium nitrate, hydrogen peroxide, compounds which release hydrogen peroxide under acid conditions, sodium hypochlorite, perphospates and peborates.

All of the prior art phosphating solutions and processes have certain serious problems. The use of nitrites, which evolves noxious fumes, poses obvious environmental dangers. Moreover, effluent containing nitrites are particularly dangerous and require treatment before disposal.

DESCRIPTION OF THE INVENTION

This invention affords a phosphating solution and method suitable for forming phosphate conversion coatings on metallic substrates such as iron, zinc, aluminum, or various alloys and combinations thereof such as steel, galvanized steel, and the like, iron and iron alloys being preferred.

The phosphating solution is based upon generally known types of aqueous solutions employing zinc ions and phosphate ions, although the specific amounts of such ions utilized herein are not necessarily known. Optionally, divalent metal ions such as calcium ions, manganese ions, nickel ions, and/or cobalt ions may also be present, nickel ions being preferred. In a preferred embodiment, iron ions are also present, most preferably, being obtained not from an ingredient of the solution per se, but rather from the metallic substrate being treated, which therefore must be a ferriferrrous metal or an alloy thereof such as steel. A most critical aspect of this invention is that the phosphating solution contains both of two different accelerators, which are (a) a bromate compound, especially an alkali metal bromate, and (b) a nitroaromatic.

Alkali metal bromates useful in this invention are preferably sodium bromate and/or potassium bromate, sodium bromate being most preferred.

Nitroaromatics useful in this invention are m-nitrobenzene sulfonate or a water soluable salt thereof dinitrobenzene sulfonate or a water soluable salt thereof, para-nitrophenol, or any mixture thereof. Metanitrobenzene sulfonate is preferred, particularly in the form of its sodium or potassium, especially sodium, salt.

The zinc ions may be derived from known sources conventional in phosphating solutions, such as zinc oxide and zinc phosphate. The particular source of the zinc ions is not critical, providing that the compound readily dissociates in the phosphating solution, and further provided that the anion does not cause processing or dangerous environmental problems. A preferred source is $Zn(H_2PO_4)_2$, which affords both useful zinc cations and useful phosphate anions.

The phosphate ions may be derived from known sources conventional in phosphating solutions, such as alkali metal phosphates, alkaline earth metal phosphates, ammonium phosphate, other metal phosphates, and (ortho) phosphoric acid. Examples of useful phosphates are: sodium dihydrogen phosphate—$NaH_2PO_4$; zinc phosphate—$Zn(H_2PO_4)_2$; manganese phosphate—$Mn(H_2PO_4)_2$; and (ortho) phosphoric acid—$H_3$-

$PO_4$ (which forms phosphates with other metal ions which are soluble under certain conditions). The particular source of the phosphate ($PO_4$) ions in not critical.

As is conventional in conversion coating solutions, the amount of each ingredient is given in grams per liter (g/l) based upon 1 liter of aqueous solution. The amounts are measured by the desired ions themselves, without regard to their dissociated co-ions. The invention accelerator composition is an exception, since amounts of its components are measured by the entire respective compounds. Amounts of each ingredient are given in the following table. $NaBrO_3$ is given as a representative bromate and NBS (m-nitrobenzene sulfonate) is given as a representative nitroaromatic.

TABLE 1

| | Ingredients (g/l) | | | | | | |
|---|---|---|---|---|---|---|---|
| Range | Zn ions | Mn ions* | Ni ions* | Co ions* | $PO_4$ ions | $NaBrO_3$ | NBS |
| Acceptable | 1.2–2.2 | 0–2 | 0–1.5 | 0–1.5 | 13–30 | 0.5–1.2 | 0.2–0.6 |
| Preferred | 1.2–2.0 | 0.1–2 | 0.1–1.5 | 0.1–1.5 | 16–24 | 0.7–1.1 | 0.2–0.5 |
| Most Preferred | 1.3–2.0 | 0.7–.95 | .25–.5 | — | 16–21 | 0.8–1.1 | 0.25–0.5 |
| Optional Ingredient | | X | X | X | | | |

*Preferably the total of Mn, Ni, and/or Co ions is not more than 1.0 g/l

The process parameters for this invention are as follows:

Temperature of phosphating solution:
35°–45° C.,
Preferably 35°–42° C.
Most Preferably 38°–40° C.

Time—spraying only:
90–120 seconds

Time—spraying/dip:
20–30 seconds spraying, followed by
150–120 seconds dipping

Time—dipping only:
180 seconds

All of the above times are approximate and may vary depending upon factors such as the configuration of the substrate, ambient temperature, temperature of the phosphating solution, and the like. The manner of application (i.e., spraying, dipping, or any combination thereof) is not critical. However, the temperature of the phosphating solution is important, and should be kept within the above limits to maintain optimum phosphating efficiency, while minimizing the danger of environmental pollution and the expenditure of energy.

The total acid content of the phosphating solutions of this invention is 18–25 points, preferably 20–22 points. The free acid content of the phosphating solutions of this invention is 0.5–1 points, preferably 0.6–0.08 points. Methods for determining total acid and free acid are well known. These terms are typically defined in the aforementioned British Pat. No. 983,924 at column 2, line 24–33.

In order to overcome the problems encountered in the prior art, the accelerators employed in the process according to the invention must meet the following requirements:

They must be stable in phosphate solution;
they must be compatible with the environment;
they must be readily quantifiable in solution in order to enable final control of the operational parameters of the phosphation reaction to be established;
they must undergo complete dissolution in the phosphate solution; and
they themselves (or their reduced products) must not give rise to any problems with respect to the kinetics and the further properties of the phosphate layer deposition.

The composition and process according to the present invention, upon selection of suitable concentrations, enables a phosphate conversion coating to be appropriately deposited, even without heating the phosphating solution. This, because of the savings in energy consumption, comprises a great advantage over the prior art processes.

In the process utilizing the composition of this invention, the metal substrate, and more specifically the iron or iron alloy substrate, onto which the phosphate is to be deposited, is degreased by contacting it with an alkaline degreasing solution which may or may not contain a layer-refining agent. After contact by spraying or immersing, the substrate is rinsed with tap water and reacted with a phosphating solution according to the invention. After a reaction has occurred between the phospating solution and the metal substrate, the substrate is rinsed and dried or otherwise subjected to a final passivation reaction with solutions of known post-rinse compounds which may contain trivalent and/or hexavalent chromium or other ingredients.

The reaction between the metal (especially iron) substrate and the phosphating solution, results in the deposition of zinc phosphate crystals containing iron, zinc, and a certain amount of other metals, when they are present. Such crystals are very small in size (in most cases less than 10 microns) and provide high corrosion resistance and adhesion in combination with further coatings applied thereto, particularly in combination with coatings applied thereon by cathodic electro-deposition.

A typical phosphating solution to be employed in the present invention may be represented by the following:

| | |
|---|---|
| $H_3PO_4$ (75%) | 0.8 g/l |
| $Zn(H_2PO_4)_2$ | 4.0 g/l |
| $NaH_2PO_4$ | 17.0 g/l |
| $NaBrO_3$ | 0.8 g/l |
| $Ni(NO_3)_2$ | 1.2 g/l |
| NBS | 0.3 g/l |
| $H_2O$ | Balance to 1 liter. |

The phosphate layers obtained thereby have a desireably very low layer weight, weights in the order of magnitude of between 1.0 to 1.65 g/m$^2$ being readily attainable. Excellent results are achieved with respect to adhesion and corrosion resistance in combination with coatings of all types, and specifically in combination with coatings which are cathodically electrodeposited.

The phospating solutions may also contain other accelerations such as chlorates, although this is not preferred.

The solution also may contain cations of alkaline substances such as Na and/or $NH_4$ in order to maintain the concentration of free acid within the tolerance limits.

The present invention is further illustrated by the following non-limitative examples.

EXAMPLE 1

Composition of the phosphation solution:

| | |
|---|---|
| $H_3PO_4$ (75%) | 0.7 g/l |
| $Zn(H_2PO_4)_2$ | 3.8 g/l |
| $NaH_2PO_4$ | 17 g/l |
| $NaBrO_3$ | 0.8 g/l |
| NBS | 0.6 g/l |
| $Ni(NO_3)_2$ | 1.4 g/l |
| NaBr | 0.5 g/l |
| $H_2O$ | Balance to 1 liter. |

The phosphating solution having been heated to 50° C. was contacted by spraying with a previously degreased steel surface for 2 minutes whereby a layer having an area weight of 1.2 g/m$^2$ was obtained. This is a higher temperature than is normally used.

EXAMPLE 2

Composition of the phosphation solution:

| | |
|---|---|
| $H_3PO_4$ (75%) | 0.8 g/l |
| $Zn(H_2PO_4)_2$ | 4.2 g/l |
| $NaH_2PO_4$— | 18.0 g/l |
| $NaBrO_3$ | 0.5 g/l |
| NaBr | 0.3 g/l |
| $Ni(NO_3)_2$ | 1.0 g/l |
| $Mn(H_2PO_4)_2$ | 3.0 g/l |
| NBS | 0.5 g/l |
| $H_2O$ | Balance to 1 liter. |

The phosphating solution was contacted by immersing at 45° C. with a previously degreased steel surface for 3 minutes whereby a layer having an area weight of 1.5 g/m$^2$ was obtained.

EXAMPLES 3–9

Further, particularly useful, examples are given in the following table.

TABLE 2

| | Ingredient (g/l) | | | | | | Spray Conditions | | Layer |
|---|---|---|---|---|---|---|---|---|---|
| Example No. | Zn ions | Mn ions | Ni ions | $PO_4$ ions | $NaBrO_3$ | NBS | time (min.) | temp. (°C.) | Amount (g/m$^3$) |
| 3 | 1.3 | — | — | 16 | 1.0 | 0.25 | 2 | 40 | 1.3 |
| 4 | 1.9 | — | — | 18 | 1.1 | 0.3 | 2 | 40 | omitted |
| 5 | 1.7 | — | 0.3 | 18 | 0.9 | 0.3 | 2 | 40 | 1.4 |
| 6 | 1.4 | — | 0.45 | 20 | 0.8 | 0.5 | 2 | 42 | 1.2 |
| 7 | 1.9 | 0.7 | 0.3 | 20.5 | 0.8 | 0.5 | 2 | 40 | 1.5 |
| 8 | 2.0 | — | 0.5 | 19 | 1.0 | 0.3 | 2 | 40 | 1.55 |
| 9 | 1.4 | 0.93 | 0.25 | 21 | 1.0 | 0.35 | 2 | 40 | 1.65 |

The solutions of Examples 3–9 were applied to the following substrates:

Steel: cold strip steel ST 1405

Galvanization: electrolytically galvanized steel, application 7.5μ.

Aluminum: sheets: Al 89.5 semi-hard.

The following conversion coating layer weights were obtained:

| | |
|---|---|
| Spraying: | 1.0–1.8 g/m$^2$ on steel<br>2.0–2.4 g/m$^2$ on EG = (electrolytically galvanized steel) |
| Spraying/ dipping: | 1.2–2.0 g/m$^2$ on steel<br>2.0–2.5 g/m$^2$ on EG |

-continued

| | |
|---|---|
| Dipping: | 1.5–2.0 g/m$^2$ on steel<br>2.0–2.5 g/m$^2$ on EG |

The conversion coated substrates were then lacquered and subjected to corrosion testing with the following very satisfactory results:

| Corrosion Results: | | | |
|---|---|---|---|
| 1,000 hours | salt spray test for steel | | |
| 480 hours | salt spray test electrolytically glavanized steel | | |
| Lacquer 1: | Catodip from Glasurity Company | | KETL ca. 20 nm |
| | Epoxide | FT-83-0268-1 | Transparent lacquer |
| | | FT-84-7005-1 | Paste with pigments |
| Under-migration in parallel section: 1–1.5 mm | | | Blistering |

EXAMPLE 3

| | | |
|---|---|---|
| mm | 1–1.5 | blisters some points (steel) |
| mm | ca. 2 | blisters some points (EG) |

EXAMPLE 4

| | | |
|---|---|---|
| mm | 1.5 | blisters no points (steel) |
| mm | 1.5 | blisters some points (EG) |

EXAMPLE 5

| | | |
|---|---|---|
| mm | 1 | blisters no points (steel) |
| mm | 1.5 | blisters some points (EG) |

EXAMPLE 6

| | | |
|---|---|---|
| mm | 0.5 | blisters no points (steel) |
| mm | 2 | blisters some points (EG) |

EXAMPLE 7

| | | |
|---|---|---|
| mm | 0.5 | blisters no points (steel) |
| mm | 1 | blisters some points (EG) |

EXAMPLE 8

| | | |
|---|---|---|
| mm | 1.5 | blisters no points (steel) |

-continued

| | | |
|---|---|---|
| mm | 2 | blisters some points (EG) |

EXAMPLE 9

| | | |
|---|---|---|
| mm | 1 | blisters no points (steel) |
| mm | 1 | blisters some points (EG) |
| Lacquer 2: | KETL from the firm of Herberts ca. 20 nm Epoxide R 18015 | |
| Same as above | Same as above | |

EXAMPLE 3

| | | |
|---|---|---|
| mm | 1–1.5 | blisters no points (steel) |
| mm | ca. 2 | blisters some points (EG) |

EXAMPLE 4

| | | | |
|---|---|---|---|
| mm | ca. | 1.5 | blisters some points (steel) |
| mm | ca. | 1.5 | blisters no points (EG) |

EXAMPLE 5

| | | |
|---|---|---|
| mm | 1 | blisters no points (steel) |
| mm | 1.5 | blisters some points (EG) |

EXAMPLE 6

| | | |
|---|---|---|
| mm | 0.5 | blisters no points (steel) |
| mm | ca. 2 | blisters no points (EG) |

EXAMPLE 7

| | | |
|---|---|---|
| mm | 0.5 | blisters no points (steel) |
| mm | ca. 1 | blisters no points (EG) |

EXAMPLE 8

| | | |
|---|---|---|
| mm | 1.5 | blisters no points (steel) |
| mm | 2 | blisters no points (EG) |

EXAMPLE 9

| | | |
|---|---|---|
| mm | 1 | blisters no points (steel) |
| mm | ca. 1 | blisters some points (EG) |

It should further be noted that the following weight ratios of the various ingredients are desired:

| | | |
|---|---|---|
| phosphate: | zinc | 7–20:1; |
| phosphate: | bromate | 14–48:1; |
| zinc: | bromate | 1.2–4:1; and |
| bromate: | nitroaromate | 1–5:1. |

What is claimed is:

1. A composition for phosphate coating a metallic substrate consisting essentially of an aqueous solution of:

(a) zinc ions present in about 1.2–2.2 g/l;
(b) phosphate ions present in about 13–30 g/l;
(c) a bromate compound present in about 0.5–1.2 g/l;
(d) a nitroaromatic compound present in about 0.2–0.5 g/l;
(e) manganese ions optionally present in 0 to about 2 g/l;
(f) nickel ions optionally present in 0 to about 1.5 g/l;
(g) cobalt ions optionally present in 0 to about 1.5 g/l; and
(h) water q.s. to 1 liter units;

wherein said solution has a total acid value of about 18–25 points and a free acid value of about 0.5–1 points.

2. The composition of claim 1 wherein said bromate compound is sodium bromate, potassium bromate, or their mixture.

3. The composition of claim 1 wherein said bromate compound is sodium bromate.

4. The composition of claim 1 wherein said nitroaromatic compound is: meta-nitrobenzene sulfonate or a water-soluble salt thereof; dinitrobenzene sulfonate or a water-soluble salt thereof; para-nitrophenol, or their mixture.

5. The composition of claim 1 wherein said nitroaromatic compound is: meta-nitrobenzene sulfonate or a water-soluble salt thereof.

6. The composition of claim 2 wherein said nitroaromatic compound is: meta-nitrobenzene sulfonate or a water-soluble salt thereof.

7. The composition of claim 1 wherein said nitroaromatic compound is the sodium or potassium salt of meta-nitrobenzene sulfonate.

8. The composition of claim 2 wherein said nitroaromatic compound is the sodium or potassium salt of meta-nitrobenzene sulfonate.

9. The composition of claim 3 wherein said nitroaromatic compound is the sodium salt of meta-nitrobenzene sulfonate.

10. The composition of claim 1 wherein ingredient
(a) is present in 1.2–2.0 g/l;
(b) is present in 16–24 g/l;
(c) is present in 0.7–1.1 g/l; and
(d) is present in 0.2–0.5 g/l.

11. The composition of claim 8 wherein ingredient
(a) is present in 1.2–2.0 g/l;
(b) is present in 16–24 g/l;
(c) is present in 0.7–1.1 g/l; and
(d) is present in 0.2–0.5 g/l.

12. The composition of claim 1 wherein ingredient
(a) is present in 1.3–2.0 g/l;
(b) is present in 16–21 g/l;
(c) is present in 0.8–1.1 g/l; and
(d) is present in 0.25–0.5 g/l.

13. The composition of claim 9 wherein ingredient
(a) is present in 1.3–2.0 g/l;
(b) is present in 16–21 g/l;
(c) is present in 0.8–1.1 g/l; and
(d) is present in 0.25–0.5 g/l.

14. The composition of claim 1 wherein at least one of ingredient
(e) is present in 0.1–2 g/l;
(f) is present in 0.1–1.5 g/l; or
(g) is present in 0.1–1.5 g/l;

with the proviso that the total of (e), (f), and (g) is not more than about 1.0 g/l.

15. The composition of claim 11 wherein at least one of ingredient (e) is present in 0.1–2 g/l;

(f) is present in 0.1–1.5 g/l; or (g) is present in 0.1–1.5 g/l;

with the proviso that the total of (e), (f), and (g) is not more than about 1.0 g/l.

16. The composition of claim 13 wherein at least one of ingredient (e) is present in 0.1–2 g/l;

(f) is present in 0.1–1.5 g/l; or (g) is present in 0.1–1.5 g/l;

with the provison that the total of (e), (f), and (g) is not more than about 1.0 g/l.

17. The composition of claim 1 wherein said solution has a total acid value of about 20–22 points and a free acid value of about 0.6–0.8 points.

18. A method for applying a phosphate conversion coating to a clean metallic substrate comprising treating said substrate with the solution of claim 1 for a period of time long enough to effect the deposition of said conversion coating, which solution has been preheated to about 35°–45° C.

19. A method for applying a phosphate conversion coating to a clean metallic substrate comprising treating said substrate with the solution of claim 8 for a period of time long enough to effect the deposition of said conversion coating, which solution has been preheated to about 35°–45° C.

20. A method for applying a phosphate conversion coating to a clean metallic substrate comprising treating said substrate with the solution of claim 9 for a period of time long enough to effect the deposition of said conversion coating, which solution has been preheated to about 35°–45° C.

21. A method for applying a phosphate conversion coating to a clean metallic substrate comprising treating said substrate with the solution of claim 10 for a period of time long enough to effect the deposition of said conversion coating, which solution has been preheated to about 35°–45° C.

22. A method for applying a phosphate conversion coating to a clean metallic substrate comprising treating said substrate with the solution of claim 13 for a period of time long enough to effect the deposition of said conversion coating, which solution has been preheated to about 35°–45° C.

23. A method for applying a phosphate conversion coating to a clean metallic substrate comprising treating said substrate with the solution of claim 16 for a period of time long enough to effect the deposition of said conversion coating, which solution has been preheated to about 35°–45° C.

24. The method of claim 18 wherein said treatment is by spraying said substrate for about 90–120 seconds.

25. The method of claim 18 wherein said treatment is by dipping said substrate in said solution for about 180 seconds.

26. The method of claim 18 wherein said treatment is by spraying said substrate for 20–30 seconds, followed by dipping said substrate in said solution for 150–180 seconds.

27. The method of claim 18 wherein said metallic substrate is at least one: ferriferrous metal or alloy thereof, zinc or alloy thereof; or aluminum or alloy thereof.

28. The method of claim 18 wherein said metallic substrate is a ferriferrous metal or an alloy thereof.

29. The method of claim 18 wherein said solution is preheated to 35°–40° C.

30. The method of claim 18 wherein said solution is preheated to 38°–40° C.

31. The method of claim 18 wherein said substrate, after said treatment, is subjected to a post-rinse.

32. The composition of claim 1 having ingredient weight ratios of:

b:a of 7–20:1;

b:c of 14–48:1;

a:c of 1.24–4:1; and c:d of 1–5:1.

33. The method of claim 18 wherein the composition ingredients have weight ratios of:

b:a of 7–20:1;

b:c of 14–48:1;

a:c of 1.24–4:1; and c:d of 1–5:1.

34. An accelerator composition for a phosphate conversion coating aqueous solution containing zinc ions and phosphate ions, consisting essentially of:

(a) a bromate compound; and (b) a nitroaromatic compound.

* * * * *